US011702893B2

(12) United States Patent
Smith

(10) Patent No.: US 11,702,893 B2
(45) Date of Patent: Jul. 18, 2023

(54) DISSOLVABLE DOWNHOLE CONNECT TOOL

(71) Applicant: Snub Equipment Ltd., Olds (CA)

(72) Inventor: Nathan Smith, Olds (CA)

( * ) Notice: Subject to any disclaimer, the term of this patent is extended or adjusted under 35 U.S.C. 154(b) by 0 days.

(21) Appl. No.: 17/517,614

(22) Filed: Nov. 2, 2021

(65) Prior Publication Data

US 2022/0136336 A1 May 5, 2022

(30) Foreign Application Priority Data

Nov. 2, 2020 (CA) ..... CA 3097826

(51) Int. Cl.
*E21B 17/046* (2006.01)
*E21B 17/06* (2006.01)

(52) U.S. Cl.
CPC ..... *E21B 17/0465* (2020.05); *E21B 17/06* (2013.01); *E21B 2200/08* (2020.05)

(58) Field of Classification Search
CPC .... E21B 17/0465; E21B 17/046; E21B 17/04; E21B 17/06; E21B 17/02; E21B 17/041; E21B 2200/08; E21B 33/00
See application file for complete search history.

(56) References Cited

U.S. PATENT DOCUMENTS 5,086,844 A * 2/1992 Mims ..... E21B 43/10 166/212
2018/0299046 A1* 10/2018 Sessa ..... F16L 21/035

* cited by examiner

*Primary Examiner* — Kristyn A Hall
(74) *Attorney, Agent, or Firm* — Sander R. Gelsing

(57) ABSTRACT

A drill string connect tool comprises a housing having first and second sections. The first section has a first recess, and the second section has a second recess. The tool and the first and sections may be in a connected configuration or a disconnected configuration. The connect tool comprises at least one tension member placeable within, and suitable to transfer tensile forces between, the first and second sections when in the connected configuration. A retaining member can retain the tension member within the first and second recesses. The retaining member is selectively dissolvable by a dissolving fluid, while the remaining components of the tool can withstand the dissolving fluid. When exposed to a dissolving fluid, the retaining member dissolves, allowing the tension member to exit the first and second recesses, thereby actuating the tool to the disconnected configuration.

4 Claims, 4 Drawing Sheets

DISSOLVABLE DOWNHOLE CONNECT TOOL

FIELD OF THE INVENTION

This invention relates generally to connect/disconnect tools and devices. More particularly, the invention relates to connect/disconnect tools for use with bottom hole assembly (BHA) or other well drilling equipment and well completion equipment.

BACKGROUND OF THE INVENTION

The background information discussed below is presented to better illustrate the novelty and usefulness of the present invention. This background information is not admitted prior art.

In the oil and gas industries, connect/disconnect devices are commonly incorporated into tubulars, such as drill strings, completion strings and coiled tubing.

They are typically a two-part device, initially assembled in a connected configuration and placed within the string. Such tools may be referred to as a "drilling disconnect", "disconnect" or even "connect tool". They are often used to separate a bottom hole assembly (BHA) from the remainder of the string if, for example, the BHA becomes stuck. Once the string has been disconnected from the BHA, the operators can then pull up the disconnected portion of the string and attempt to recover the stuck BHA with a "fishing" tool.

Typical methods for disconnecting a string from a stuck BHA involve dropping a ball or dart from the surface, through the string's interior, to interact with a shear pin or other locking device within the connect/disconnect device and actuate the separation. For example, a ball might be pumped down the string's interior and seat in the disconnect device. Then pumping additional pressure into the string's interior will push the ball to actuate the disconnect device to a disconnect configuration, wherein one part remains attached to the BHA and the other part remains attached to the string portion that is above the BHA, thereby causing the BHA to disconnect from the remainder of the uphole portion of the string.

However, such disconnect devices require there to be a clear pathway for such ball or dart to move from the surface, through the entire string's interior, and to seat in the disconnect device. Many well operations place specialized tools and the like at various locations in the string. Such specialized tools do not always provide a clear path for balls or darts to pass through them. Or they themselves require a ball to actuate them, thereby trapping any ball that would otherwise travel further down the string to the connect/disconnect device.

For example, drill string agitators are used to shake and shock the drill string, to keep it moving sideways and to reduce the downhole friction of the string. However, they are normally put 1000 meters or more back from the BHA (as that is where they are most effective to reduce friction). Moreover, such agitators do not normally allow for a ball or dart to pass through them, typically only drill string fluids pass through such tools. As such, conventional ball-actuated disconnect devices will need to be place above any agitators (i.e. closer to surface). If the BHA in such a drill string gets stuck, then actuating the disconnect will typically leave a very long string portion in the wellbore; i.e. hundreds or thousands of meters of string from the agitator down to the BHA. Subsequent removal of such a large piece of stuck string will then be costly and complicated.

Therefore, what is needed is a tool that overcomes the disadvantages of these conventional ball-actuated connect/disconnect devices.

SUMMARY OF THE INVENTION

In an embodiment of the invention, there is provided a connect tool for use with a drill string comprising a tubular housing having a first and a second end, an exterior surface and defining an interior volume, openings provide access to the interior volume. The tubular housing further comprises a first and a second section. The first section has a first recess and the second section has a second recess. The first and the second sections may be in a connected configuration or a disconnected configuration. A connection is provided between the first and the second sections. At least one tension member is placeable within, and suitable to transfer tensile forces between, the first and second sections when the tool is in the connected configuration. The tubular housing further comprises: a retaining member to retain the tension member within the first and second recesses. The retaining member is selectively dissolvable by a dissolving fluid while the remaining components of the connect tool are comprised of a material that can withstand said dissolving fluid

BRIEF DESCRIPTION OF THE DRAWINGS

Referring to the drawings, several aspects of the present invention are illustrated by way of example, and not by way of limitation, in detail in the figures, wherein.

DETAILED DESCRIPTION OF THE PREFERRED EMBODIMENTS

Figure 1A:
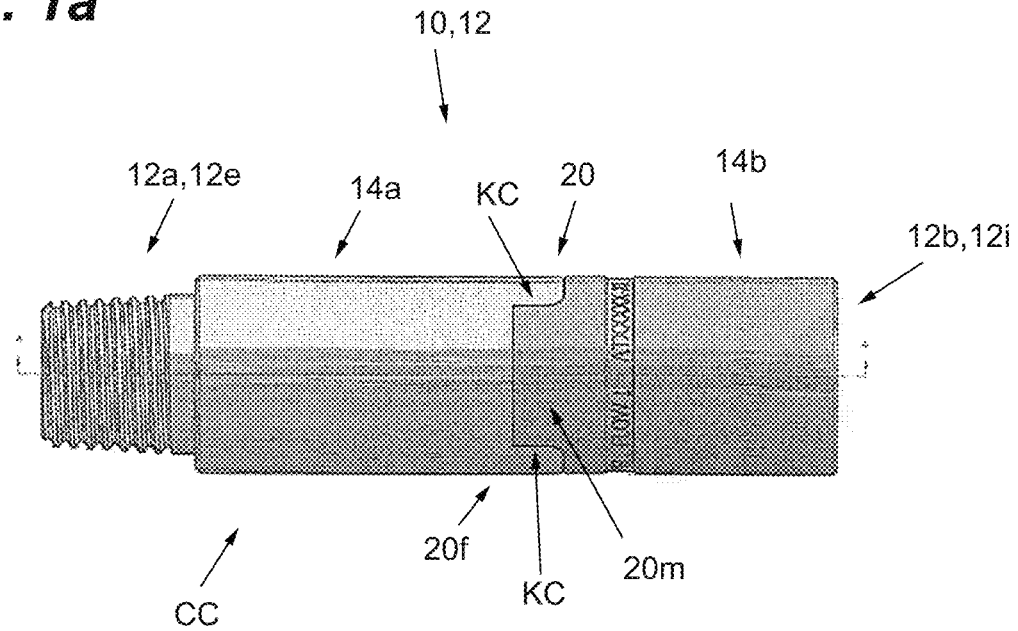
FIG. 1*a* is a side view of one embodiment of a connect and disconnect tool of the present invention, shown in the connected configuration.
Figure 1B:
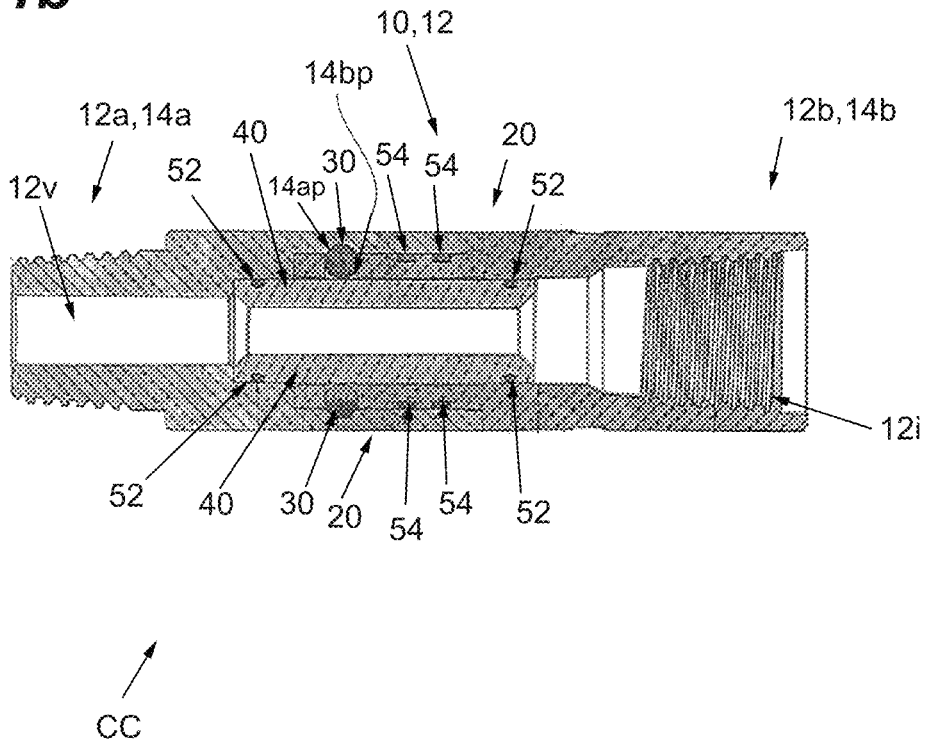
FIG. 1*b* is a sectioned view of the embodiment of FIG. 1*a;*

The following description is of preferred embodiments by way of example only and without limitation to the combination of features necessary for carrying the invention into effect. Reference is to be had to the Figures in which identical reference numbers identify similar components. The drawing figures are not necessarily to scale and certain features are shown in schematic or diagrammatic form in the interest of clarity and conciseness.

A first embodiment of the connect tool 10 of the present invention is shown in FIGS. 1*a*-2*f*. The connect tool 10 preferably comprises a cylindrical, tubular housing 12 having a first end 12*a*, a second end 12*b*, an exterior surface and defining an interior volume 12*v*. Openings at the first and second end 12*a*, 12*b* provide access to the interior volume 12*v* in a conventional manner.

To facilitate inline, sealable connection of the tool 10 within, or to, a drill string, coiled tubing string or the like, the housing 12 is preferably provided with uphole and downhole collars or connectors 12*e* and 12*i* at each respective ends 12*a* and 12*b*. Connectors 12*e* and 12*i* may be treaded connections as is conventional in the wellbore operations industry, such as an external treaded connection 12*e* and an internal threaded connection 12*i*. In the present embodiment, first end 12*a* features an external threaded connection 12*e*, and second end 12*b* features an internal threaded connection 12*i*. However, other conventional connection will also work to connect the tool 10 within tubular string.

Preferably, the connect tool 10 is a two-part device comprising a first section 14*a* and a second section 14*b*. The first and second sections 14*a*, 14*b* of the connect tool 10 may be in a connected and sealed configuration CC, or be in a disconnected configuration DC.

Since the connect tool 10 is installed within a drill string or the like, the tool 10 must be capable of transmitting torque, compression and tensile forces when in the connected and sealed configuration CC, such as if a BHA is to operate as desired. Preferably torque and compressive forces are transferred between the first and second sections 14*a*, 14*b* through a splined or keyed connection 20 in a conventional manner. Compressive forces are preferably transferred between the first and second sections 14*a*, 14*b* in a conventional manner, such as through shoulder elements on the first and second sections 14*a*, 14*b* of a keyed connection KC. The first section 14*a* may also provide a female connection end 20*f*, and the second section 14*b* may provide a male connection end 20*m*.

Preferably, tensile forces are transferred between the first and second sections 14*a*, 14*b* by means of one or more tension members 30. Tension member 30 may be a small ball 30*b*, plug or connector that is partially receivable within a first pocket or recess 14*ap* in the first section 14*a*, and partially receivable within a second pocket or recess 14*bp* in the second section 14*b*.

Figure 2A:
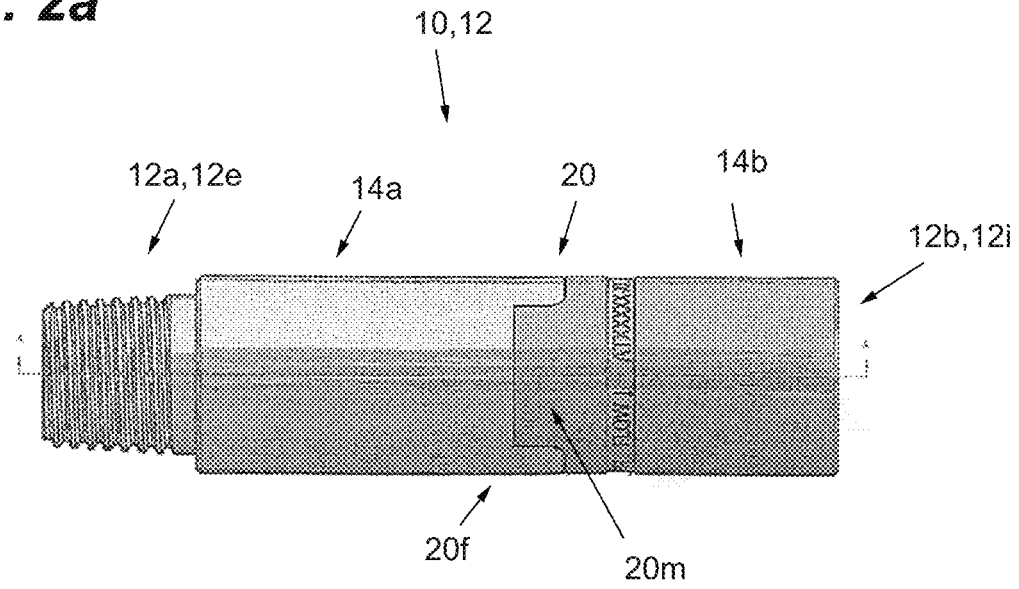
FIG. 2*a* is a side vide of the embodiment of FIG. 1*a,* shown with acidic fluid being passed through its interior.
Figure 2B:
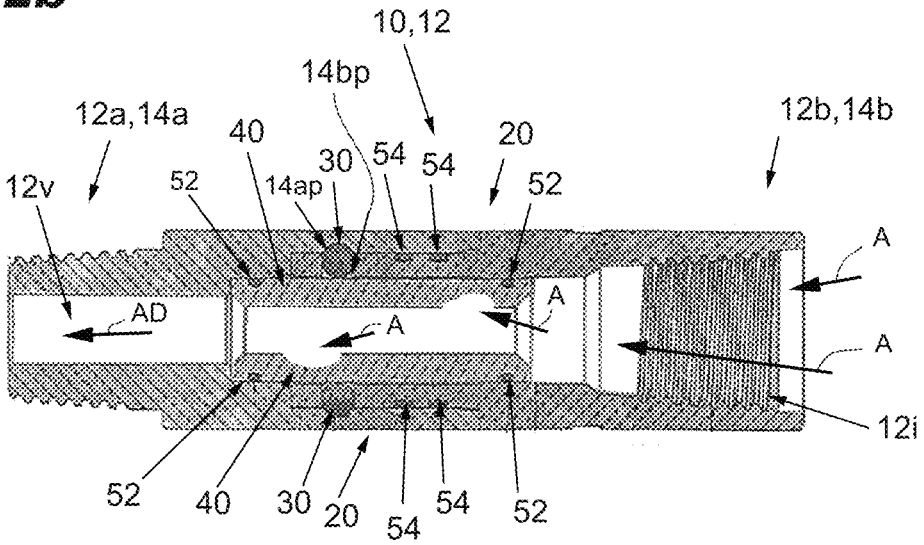
FIG. 2*b* is a sectioned view of the embodiment of FIG. 2*a;*
Figure 2C:
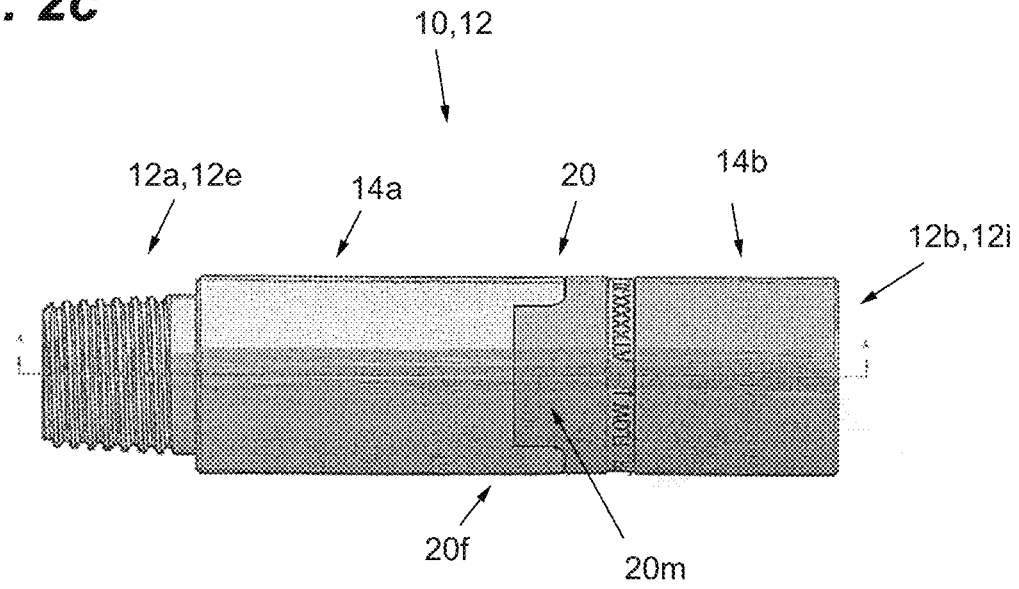
FIG. 2*c* is a side vide of the embodiment of FIG. 1*a,* shown in the connected configuration with acidic fluid having passed through its interior.
Figure 2D:
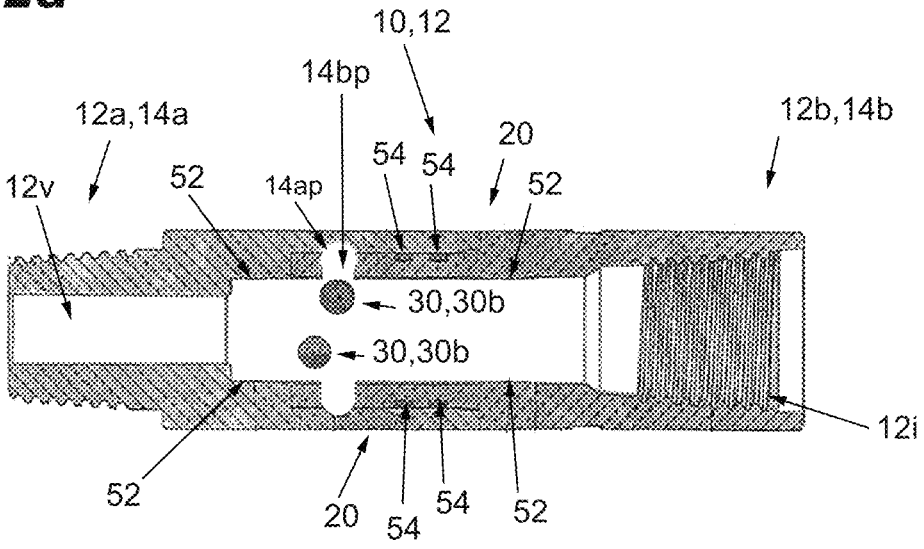
FIG. 2*d* is a sectioned view of the embodiment of FIG. 2*c;*
Figure 2E:
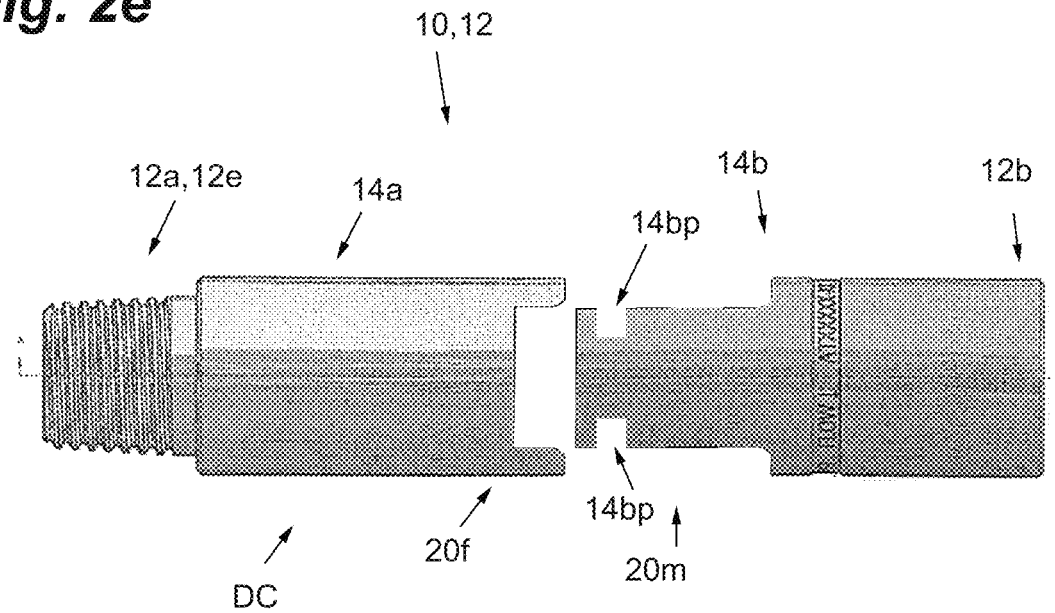
FIG. 2*e* is a side vide of the embodiment of FIG. 1*a,* shown in the disconnected configuration.
Figure 2F:
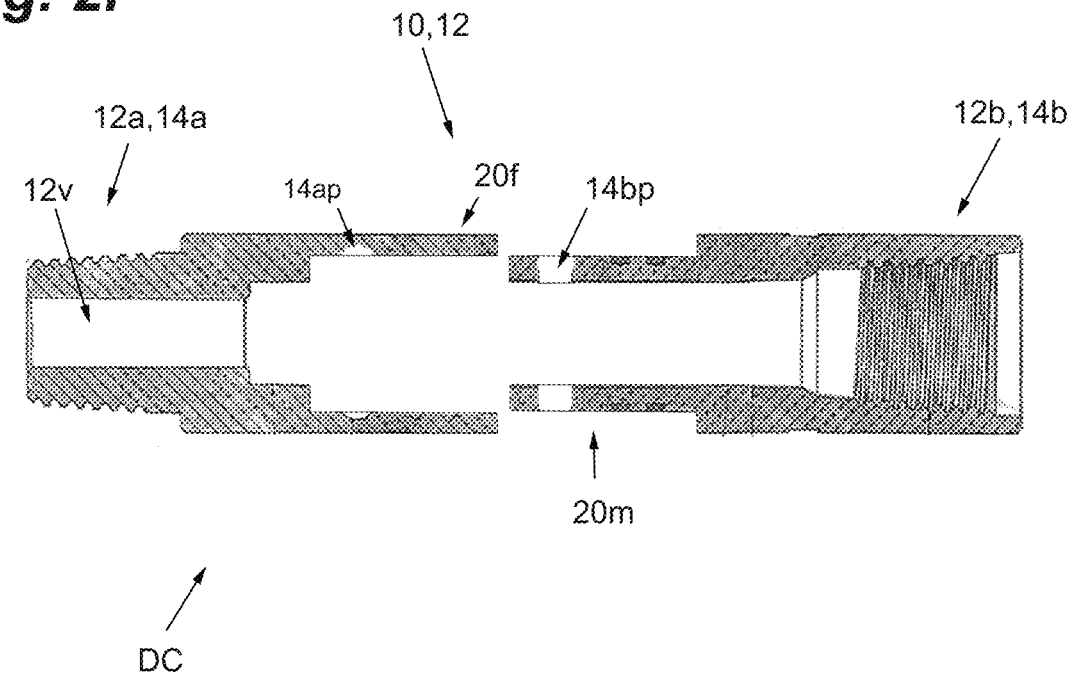
FIG. 2*f* is a sectioned view of the embodiment of FIG. 2*e*.

When in the connected and sealed configuration CC, the first and second recesses 14*ap*, 14*bp* are aligned to fully receive a tension member 30; see FIGS. 2*b* and 2*d*. As such, the recess 14*ap* in the first section 14*a*, and the recess 14*bp* in the second section 14*b*, are of sufficient size and dimensions so that together they can fully receive the tension member 30 when aligned and when in the connected and sealed configuration CC.

More preferably, the first recess 14*ap* in the first section 14*a*, and the second recess 14*bp* in the second section 14*b*, are sized so that the tension member 30 can be positioned within the collective space of said first and second recesses 14*ap*, 14*bp* (when the tool 10 is in the connected and sealed configuration CC), but not so large so that the tension member 30 might move fully within only one of said recesses 14*ap*, 14*bp*. That is, the tension member 30 and corresponding the recesses 14*ap*, 14*bp* are sized and dimensioned so that when the tension member 30 is captured within the collective space of the recesses 14*ap*, 14*bp*, the tension member 30 spans sufficiently across both recesses 14*ap*, 14*bp* so as to transfer wellbore string tension forces between the first and second sections 14*a*, 14*b*; i.e. between the internal surfaces and shoulders of first recess 14*ap*, across the tension member 30, and to the internal surfaces and shoulders of the second recess 14*bp*. It will now be appreciated that a plurality of tension members 30 (and corresponding recesses 14*ap*, 14*bp*) may be provided, with additional such members 30 (and corresponding recesses 14*ap*, 14*bp*) each improving the capacity of the tool 10 to transfer increased tensional forces between the sections 14*a*, 14*b*.

Preferably, the first and second recesses 14*ap*, 14*bp*, and the tension member 30 are sized, dimensioned and aligned so that: (i) when the tool 10 is in the connected and sealed configuration CC, (ii) when the tension member 30 is position in the collective space of the recesses 14*ap*, 14*bp*, and (iii) when the tool 10 experiences a slight jolt, tug, shake or vibration, the tension member 30 will exit the collective space of the recesses 14*ap*, 14*bp* and move into the interior volume 12*v*; see FIG. 2*d*. To put it another way, each tension member 30 and its corresponding recesses 14*ap*, 14*bp* are sized and dimensioned so that a retaining member 40 is required to prevent the tension member 30 from exiting or falling out of its corresponding recesses 14*ap*, 14*bp* (and move into the interior volume) during normal wellbore operations of the tool 10.

In a preferred embodiment, the connect tool 10 further comprises at least one retaining member 40 to maintain the one or more tension members 30 within their corresponding recesses 14*ap*, 14*bp* during normal wellbore operations of the tool 10. The retaining member 40 may be a sleeve or the like that is positioned within the interior volume 12*v* so as to block the tension members 30 from exiting their corresponding recesses 14*ap*, 14*bp*. The retaining member 40 may be placed and maintained within the interior volume by mean of friction fit or by means of an adhesive or other conventional means.

In a preferred embodiment, the retaining member 40 is suitable to withstand the normal wellbore and drill string fluids, including drilling mud, but the retaining member 40 is selectively dissolvable by a dissolving fluid A that is nor normally present in the interior of a string during wellbore operations (such as drilling). In such an embodiment, the remaining components of the tool 10 are comprised of a material that can withstand both normal wellbore fluids and the dissolving fluid A. As such, the retaining member 40 may be dissolved into the dissolving fluid A upon providing a sufficient volume (or bolus) of such dissolving liquid A through the interior volume 12*v* of the tool 10.

In a preferred embodiment, the retaining member 40 is made from aluminum, the housing 12 is made from stainless steel, the tension members 30 are also made from stainless steel, and the dissolving fluid A is hydrochloric acid. Hydrochloric acid (HCl) is commonly used in the oilfield industry for acid washing—i.e. to clean out scale and other debris that may restrict flow in an existing well.

Aluminum metal will suffer a rapid attack from hydrochloric acid (HCl) at most concentrations and temperatures. The remaining stainless-steel components will be much more resistant to hydrochloric acid, and will therefore be only minimally affected (if at all) by a bolus of such hydrochloric acid A being pushes through the interior volume 12*v* and along the retaining member 40. Such dissolving fluid A will then selectively dissolve the retaining member 40 only, while the remaining components of the tool 10 are unaffected; see FIG. 2*b*.

The dissolved components AD of the retaining member will normally exit the tool 10 and, once the retaining member 40 is sufficiently dissolved, the tension members 30 will then exit from their corresponding recesses 14*ap*, 14*bp*; see FIG. 2*d*. Once all the tension members 30 have exited from their corresponding recesses 14*ap*, 14*bp*, tensile forces are no longer transferred between the first and second sections 14*a*, 14*b* and these sections are able to separate and the tool is then in a disconnected configuration DC; see FIGS. 2*e*-2*f*.

Advantageously, this tool 10 can now be placed anywhere along a string—because a bolus of dissolving fluid A will pass through most, if not all, downhole tools, including tools such as agitators (as the fluid A will simply travel along the path that the drill string fluid takes through such tools). As such, in a drilling rig configuration the tool 10 can be placed right above the BHA, any agitators can be placed hundreds or more meters up from the tool 10 and, if a situation arises where the BHA has to be disconnected from the drill string, a simple bolus of dissolving fluid A can be run down the strings' interior into the tool's interior volume 12*v* to dissolve the retaining member 40 and thereby effect actuation of the tool 10 to the disconnected configuration DC.

In another embodiment, the dissolving fluid A may be another acid (e.g. sulfuric acid), a base (e.g. sodium hydroxide) or a concentrated brine (e.g. KCL or NaCL). In yet another embodiment all components of the tool 10, except for the retaining member 40, are provided with a protective layer or covering to prevent dissolving of any underlying materials by the dissolving fluid A.

Preferably, seals or o-rings 52 are provided to retaining member 40 to allow it to seal against the recesses 14*ap*, 14*bp* and prevent wellbore or drilling fluids from entering the recesses 14*ap*, 14*bp* while the tool 10 is in the connected configuration. More preferably, seals or o-rings 54 are provided to each of the first and second sections 14*a*, 14*b* in a conventional manner to prevent passage of wellbore and/or drilling fluids to and from the interior volume 12*v*, except through the openings at each of the first and second ends 12*a*, 12*b*.

More preferably, the various components of the apparatus 10, except for the retaining member 40, are made of stainless steel or any other suitable material that provides adequate strength, durability, sealability and rigidity to support the various loads, pressures and forces that may be encountered in a downhole, wellbore environment. More preferably, the retaining member 40 is only of such size and dimensions so as to retain the tension members 30 within their corresponding recesses 14*ap*, 14*bp*, while also being sufficiently small and thin to quickly dissolve in a bolus of dissolving fluid A. It will now be understood that the retaining member 40 need only retain the tension members 30, and it will not otherwise be subject to compressive, torque or tension forces. The retaining member 40 may also be a grid or mesh member, or it may be a wire.

Those of ordinary skill in the art will appreciate that various modifications to the invention as described herein will be possible without falling outside the scope of the invention. In the claims, the word "comprising" is used in its inclusive sense and does not exclude other elements being present. The indefinite article "a" before a claim feature does not exclude more than one of the features being present.

The invention claimed is:

1. A connect tool (10) for use with a drill string, the connect tool (10) comprising:

a tubular housing (12) having a first end (12*a*), a second end (12*b*), an exterior surface, and defining an interior volume (12*v*);

openings at the first and second ends (12*a*, 12*b*) to provide access to the interior volume (12*v*);

wherein the tubular housing (12) further comprises:

a first section (14*a*) and a second section (14*b*), wherein the first section (14*a*) has a first recess (14*ap*), wherein the second section (14*b*) has a second recess (14*bp*), and wherein the first section (14*a*) and the second section (14*b*) may be in a connected configuration or a disconnected configuration;

a connection (20) between the first section (14*a*) and the second section (14*b*);

at least one tension member (30) placeable within, and suitable to transfer tensile forces between, the first and second sections (14*a*, 14*b*) when the connect tool (10) is in the connected configuration;

wherein the tubular housing (12) further comprises:

a retaining member (40) to retain said at least one tension member (30) within said first and second recesses (14*ap*, 14*bp*) when placed therewithin;

wherein said retaining member (40) is selectively dissolvable by a dissolving fluid; and wherein the remaining components of the connect tool (10) are comprised of a material that can withstand said dissolving fluid.

2. The connect tool (10) of claim 1 wherein the housing (12) is provided with an uphole collar (12*e*) and a downhole collar (12*i*) at each of said first and second ends (12*a*, 12*b*).

3. The connect tool (10) of claim 1 wherein the at least one tension member (30) is a small ball (30b).

4. The connect tool (10) of claim 1 wherein the retaining member (40) is made from aluminum, the housing (12) is made from stainless steel, the at least one tension member (30) is made from stainless steel, and the dissolving fluid is hydrochloric acid.

* * * * *